United States Patent [19]

Eppink

[11] Patent Number: 4,641,717

[45] Date of Patent: Feb. 10, 1987

[54] CONNECTOR HOUSING

[75] Inventor: Jay M. Eppink, Spring, Tex.

[73] Assignee: Hughes Tool Company, Houston, Tex.

[21] Appl. No.: 813,804

[22] Filed: Dec. 27, 1985

[51] Int. Cl.[4] ..... F21B 7/08

[52] U.S. Cl. ..... 175/74; 175/256; 175/325

[58] Field of Search ..... 175/325, 320, 73, 74, 175/256, 61; 166/237, 241; 285/181

[56] References Cited

U.S. PATENT DOCUMENTS

| | | | |
|---|---|---|---|
| 2,375,313 | 5/1945 | Miller | 255/1.6 |
| 3,842,914 | 10/1974 | Mott | 175/320 X |
| 4,076,084 | 2/1978 | Tighe | 175/73 |
| 4,220,214 | 9/1980 | Benoit | 175/74 X |
| 4,286,676 | 9/1981 | Nguyen et al. | 175/74 |
| 4,485,879 | 12/1984 | Kamp et al. | 175/61 |
| 4,508,182 | 4/1985 | Anders | 175/74 X |
| 4,522,272 | 6/1985 | Beimgraben | 175/61 X |
| 4,572,305 | 2/1986 | Swietlik | 175/325 |

*Primary Examiner*—Stephen J. Novosad
*Assistant Examiner*—David J. Bagnell
*Attorney, Agent, or Firm*—H. Dennis Kelly

[57] ABSTRACT

A connector housing for connecting a motor housing to a bearing housing, so that the angle between the longitudinal axis of the motor housing and the longitudinal axis of the bearing housing can be changed. The connector housing has a top housing, a center housing, and a bottom housing. The top and bottom housings have angles in their respective longitudinal axes aligned in the same direction. The center housing has a pair of angles in its longitudinal axis, the sum of which is equal to the sum of the angles in the top and bottom housings. The top and bottom housings are held against rotation relative to one another, but can be rotated 180 degrees relative to the center housing. A stabilizer holds the center housing as the top and bottom housings are rotated. Dogs limit the relative rotation between the center housing and the other housings to not more than 180 degrees. A piston holds the center housing against rotation relative to the other housings whenever drilling fluid is being pumped through the connector housing. When the fluid is not being pumped through the connector housing, a spring bias the piston to a position in which the center housing can rotate relative to the other housings.

8 Claims, 6 Drawing Figures

CONNECTOR HOUSING

BACKGROUND OF THE INVENTION

1. Field of the Invention

This invention relates in general to well tools for use in drilling directional well boreholes. More specifically, the invention relates to connector housings for connecting downhole motor housings to bearing pack housings, in which the connector housings can be manipulated from the surface to cause the borehole to be drilled in a selected direction.

2. Description of the Prior Art

Many tools have been designed to cause a well borehole to be drilled in a selected direction. The best known of these tools is a bent stub, which is located between the bottom of a drill string and a downhole motor or a drill bit. The bent sub may or may not be selectively adjustable from the surface. U.S. Pat. No. 4,076,084 (Tighe), issued Feb. 28, 1978, shows an adjustable drilling tool for drilling directional boreholes.

Downhole drilling motors are designed to use the energy of drilling fluid flowing through the drill string to rotate the bit. Such motors may be turbine motors or progressive cavity motors. The latter type of motor usually has a rotor connected to a bearing shaft by a connecting rod. The motor, the connecting rod, and the bearing shaft are housed within a motor housing, a connector housing, and a bearing housing, respectively. The connector housing connects the motor housing to the bearing housing.

SUMMARY OF THE INVENTION

The connector housing of the invention can be manipulated from the surface to change the angle between the longitudinal axis of the motor housing and the longitudinal axis of the bearing housing. The connector housing has a top housing, a center housing, and a bottom housing. The top and bottom housings have angles in their longitudinal axes, which are aligned in the same direction. The center housing has a pair of angles in its longitudinal axis, which are aligned in the same direction.

The sum of the angles in the center housing is equal to the sum of the angles in the top and bottom housings. Therefore, when the angles in the top and bottom housings are aligned with the angles in the center housing, the connector housing has a total angle of ½ degree, which is sufficient to cause the bit to drill a slant hole. When the angles in the center housing are aligned opposite the angles in the top and bottom housings, the angles cancel each other and the connector housing is straight, causing the bit to drill a straight hole.

The top and bottom housings are held against rotation relative to one another. The center housing is held against rotation relative to the top and bottom housings by a piston, whenever drilling fluid is being pumped through the connector housing. However, whenever fluid is not being pumped through the connector housing, a spring forces the piston to a lower, or unlocked, position. With the piston in the lower, or unlocked position, the top and bottom housings can rotate relative to the center housing.

The drill string is then rotated to cause the top and bottom housings to rotate. A stabilizer on the center housing drags on the sides of the borehole, and causes the center housing not to rotate as fast as the top and bottom housings. The top and bottom housings are thus rotated relative to the center housing, until a pair of dogs contact. The dogs limit the rotation of the top and bottom housings relative to the center housing to no more than 180 degrees.

DESCRIPTION OF THE PREFERRED EMBODIMENT

Figure 3:
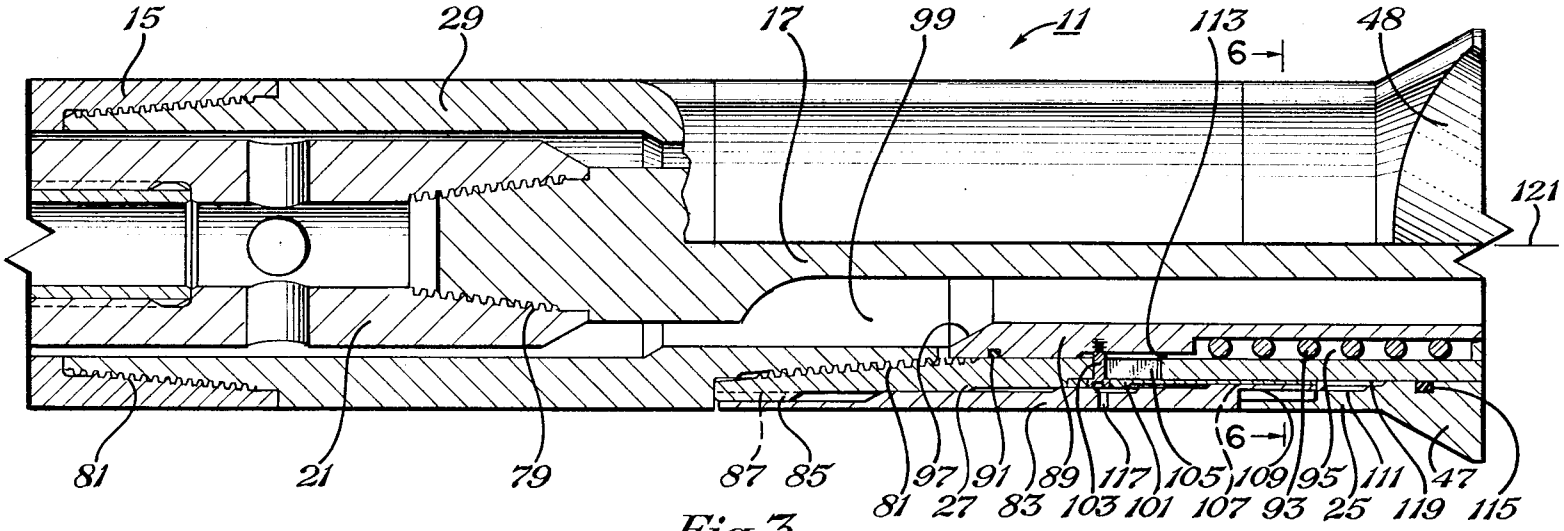
FIG. 3 is a quarter section view of the lower part of the connector housing of the invention.
Figure 4:
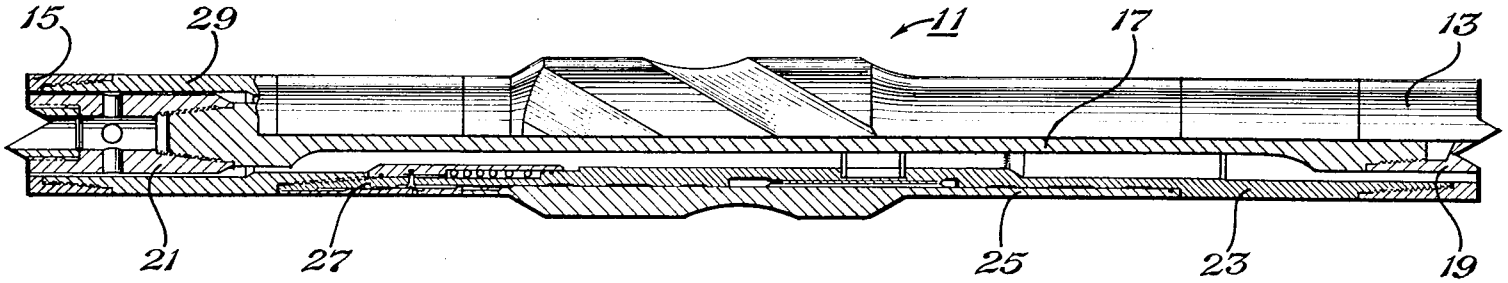
FIG. 4 is a quarter section view of the entire connector housing of the invention.

Looking first at FIG. 4, the connector housing 11 of the invention is shown, connected between a motor housing 13 and a bearing housing 15. Within the connector housing 11, a connecting rod 17 connects a rotor 19 in the motor housing 13 to a bearing shaft 21 in the bearing housing 15. The connector housing 11 consists of several components: a top housing 23, a center housing 25, a bottom housing 27, and a bottom housing extension or sub 29. The connector housing 11 is shown in greater detail in FIGS. 1–3.

Figure 1:
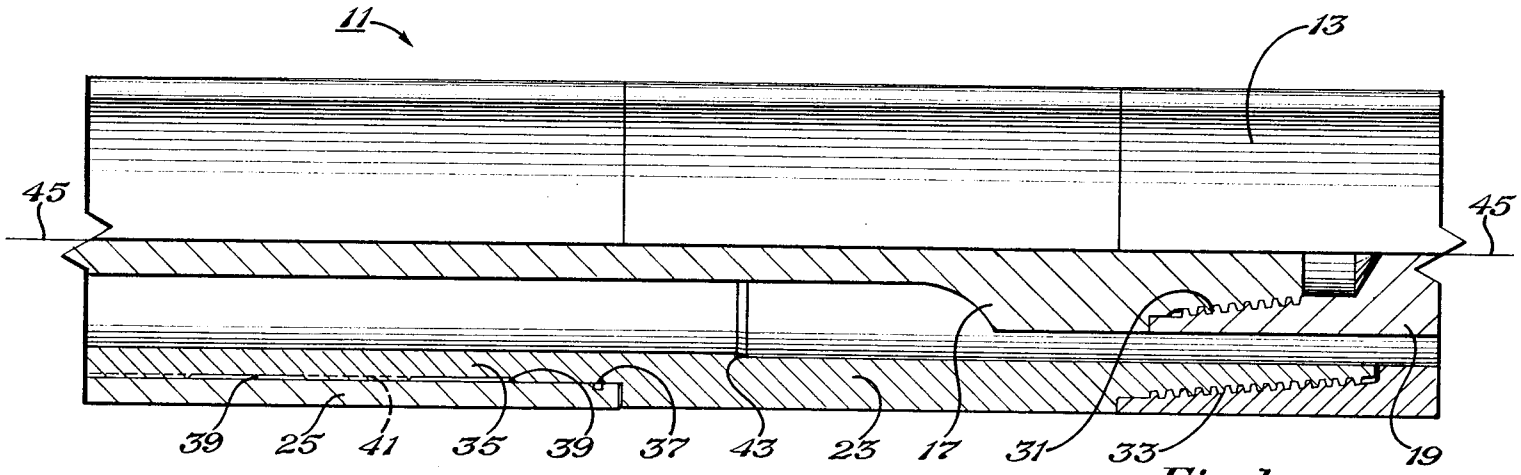
FIG. 1 is a quarter section view of the upper part of the connector housing of the invention.

FIG. 1 shows that the connecting rod 17 is connected to the rotor 19 by a standard threaded connection 31. The top housing 23 is likewise connected to the motor housing 13 by a standard threaded connection 33.

The top housing 23 has a section 35 of reduced outside diameter, which fits within the center housing 25. An O-ring seal 37 seals between this section 35 of the top housing 23 and the inner surface of the center housing 25. The outer surface of this section 35 of the top housing 23 has a plurality of circumferential grooves 39 and a plurality of longitudinal grooves 41.

At one point along the length of the top housing 23, there is a bend or angle 43 in the longitudinal axis 45 of the top housing 23. This angle 43 is preferably only about ⅛ degree, so the angle 43 is not noticeable in the drawings.

Figure 2:
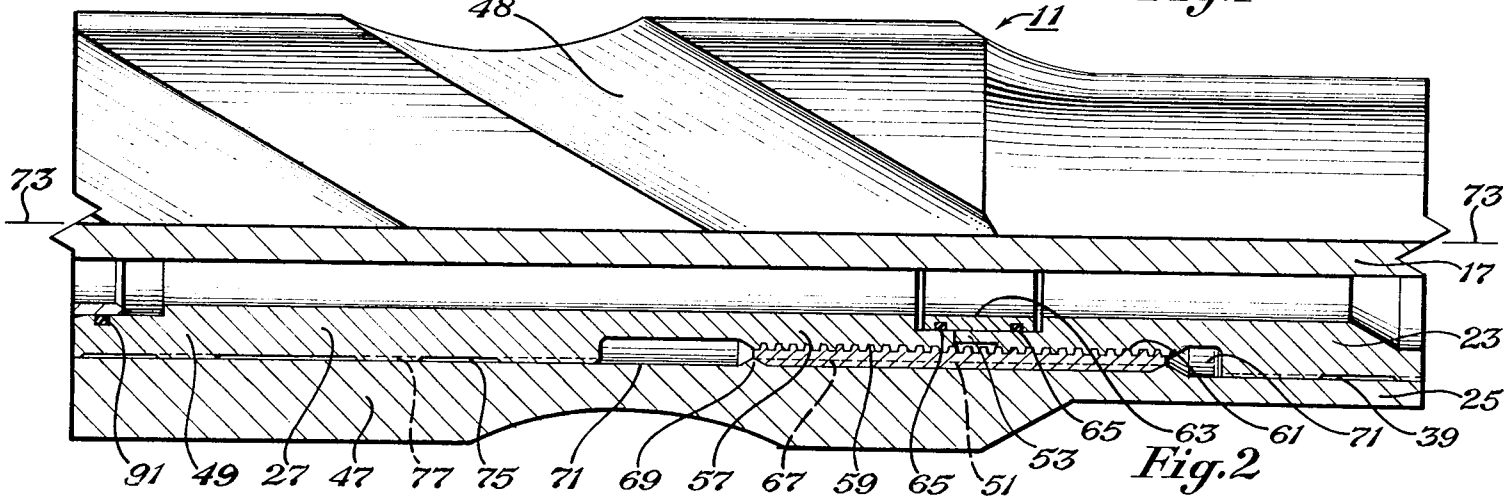
FIG. 2 is a quarter section view of the middle part of the connector housing of the invention.

FIG. 2 is a continuation of FIG. 1, showing the middle section of the connector housing 11. The center housing 25 has a stabilizer 47, which is a section of increased outer diameter. The stabilizer 47 is almost as large as the borehole, and the sides of the stabilizer 47 often contact the sides of the borehole. The stabilizer 47 thus keeps the center housing 25 centered on the longitudinal axis of the borehole. The stabilizer 47 has flutes 48 to allow passage of drilling fluid up and down the annulus between the connector housing 11 and the sides of the borehole.

Figure 5:
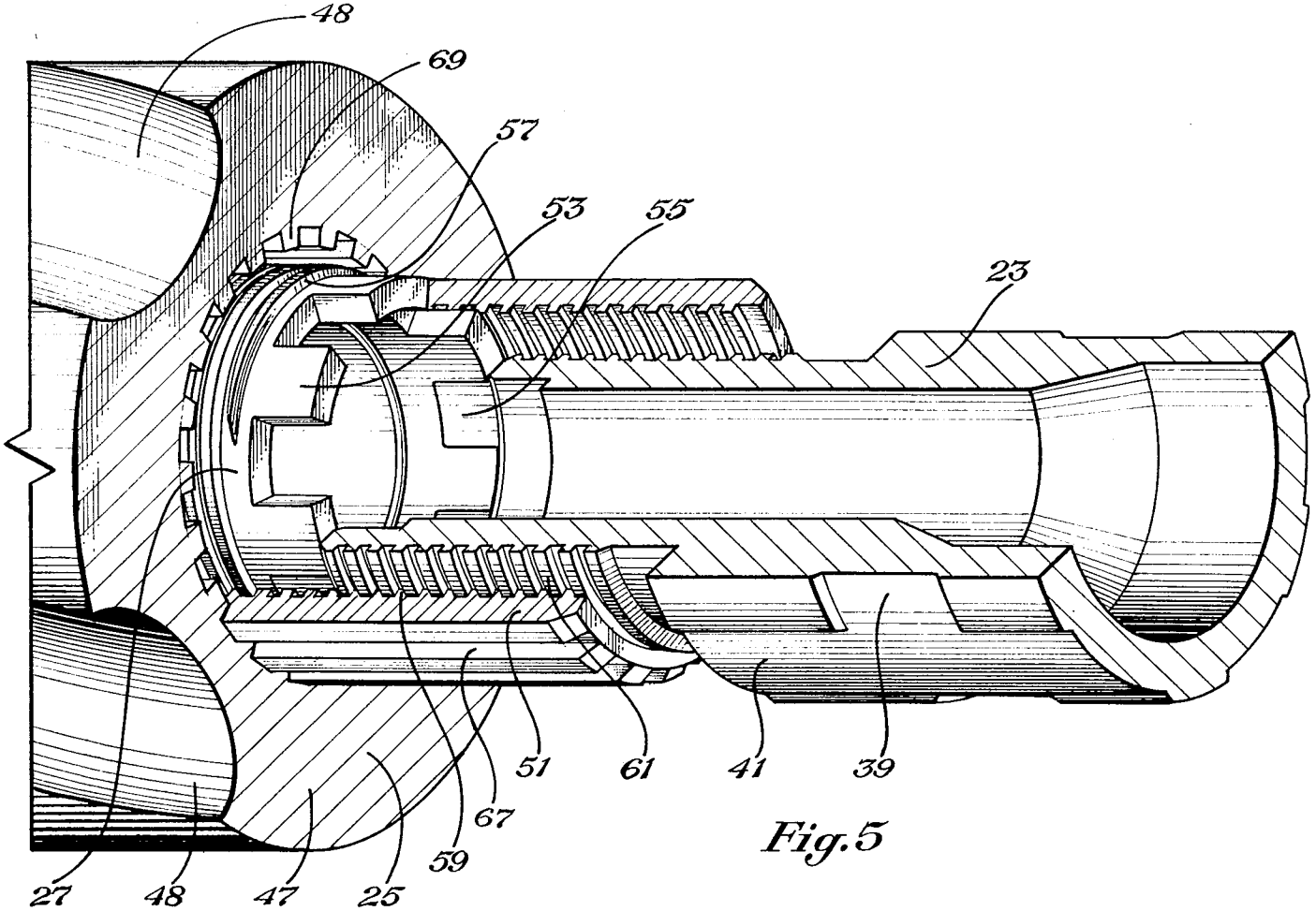
FIG. 5 is a perspective view, with some of the parts broken away, of the middle part of the connector housing of the invention.

Like the top housing 23, the bottom housing 27 has a section 49 of reduced diameter, which extends into the center housing 25. The upper end of the bottom housing 27 is connected to the lower end of the top housing 23 by a coupling 51. This connection is shown in both FIG. 2 and FIG. 5.

The upper end of the bottom housing 27 has a plurality of teeth 53. These teeth 53 mesh with a plurality of teeth 55 on the lower end of the top housing 23. Since the teeth 53, 55 mesh, the top housing 23 and the bottom housing 27 are held against rotation relative to one another. The teeth 53, 55 are thus means for preventing rotation of the top housing and the bottom housing relative to one another.

Just below the teeth 53, the bottom housing has external standard threads 57, which engage internal threads 59 on the coupling 51. Likewise, just above the teeth 55 on the lower end of the top housing 23, there are external threads 61, which also engage the internal threads 59 on the coupling 51. The threads 57 on the bottom housing 27 and the threads 55 on the top housing 23 are identical. Thus, if the coupling 51 is rotated relative to the top and bottom housings 23, 27, the coupling 51 will move up or down the threads 53, 55 of the housings 23, 27.

A metal seal ring 63 is located in a seal groove on the inner surface of the top and bottom housings 23, 27, where the teeth 53, 55 engage. This seal ring 63 has been omitted from FIG. 5 for the sake of clarity. A pair of O-ring seals 65 seal between the seal ring 63 and the top and bottom housings 23, 27.

The coupling 51 has external splines 67 on its outer surface. These splines 67 engage internal splines 69 on the inner surface of the center housing 25. Because of these splines 67, 69, the coupling 51 cannot rotate relative to the center housing 25. However, the coupling 51 will move up or down on the threads 57, 59 of the top and bottom housings 23, 27 if the coupling 51 and the center housing 25 are rotated relative to the top and bottom housings 23, 27.

At two points along the length of the center housing 25, there are bends or angles 71 in the longitudinal axis 73 of the center housing 25. Like the angle 43 in the top housing 23, these angles 71 are preferably only about $\frac{1}{8}$ degree, so the angles 43 are not noticeable in the drawings. The angles 71 in the center housing 25 are aligned in the same plane, so the total angle in the longitudinal axis 73 of the center housing 25 is $\frac{1}{4}$ degree.

FIG. 2 also shows that the bottom housing 27 has circumferential grooves 75 and longitudinal grooves 77. These grooves 75, 77 facilitate the rotation of the bottom housing 27 relative to the center housing 25.

FIG. 3 is a continuation of FIG. 2, and shows the lower section of the connector housing 11. The connecting rod 17 is connected to a bearing shaft 21 by a standard threaded connection 79. The bottom housing 27 is indirectly connected to the bearing housing 15 by the bottom housing extension 29, which has standard threads 81 at each end.

A bottom housing sleeve 83 is located around the lower end of the bottom housing 27. The bottom housing sleeve 83 has splines 85, which engage splines 87 on the bottom housing 27. The bottom housing sleeve 83 is thus held against rotation relative to the bottom housing 27.

A piston 89 is mounted on the inner surface of the bottom housing 27. The piston 89 is reciprocal between a lower, or unlocked, position, shown in FIG. 3, and an upper, or locked, position. A pair of O-ring seals 91 (one is shown in FIG. 2) seal between the piston 89 and the bottom housing 27.

A helical spring 93, mounted in an annular chamber 95, is a bias means for biasing the piston 89 toward the lower, or unlocked position. However, the piston 89 has an annular shoulder 97, which is on the lower end of the piston 89 and is exposed to fluid pressure in the bore 99 of the connector housing 11. Therefore, whenever drilling fluid is being pumped through the bore 99 of the connector housing 11, the fluid pressure will exert a force on the shoulder 97, forcing the piston 89, against the spring 93, up to the upper, or locked, position. The spring 93 is overcome, and the piston 89 is moved to the locked position by drilling fluid when the drilling fluid is pumped through the connector housing 11.

A cylindrical piston sleeve 101 is located between the bottom housing 27 and the center housing 25. The piston sleeve 101 is connected to the piston 89 by three equally spaced bolts 103, which pass through elongated slots 105 in the bottom housing 27. The slots 105 allow the bolts 103 to move up and down with the piston 89.

The piston sleeve 101 has splines 107, which engage splines 109 on the bottom housing sleeve 83. These splines 107, 109 are shown more clearly in FIG. 6. When the piston 89 is in the upper, or locked, position, the splines 107 on the piston sleeve 101 also engage splines 111 on the center housing 25, thus locking the center housing 25 against rotation relative to the bottom housing sleeve 83 and the bottom housing 27.

Whenever the piston 89 is moved to the upper, or locked, position, the size of the chamber 95 is decreased. The displaced drilling mud flows through a plurality of flats 113 on the piston 89 into the slots 105. There are three equally spaced slots 105, for the bolts 103 to move through, and there are three additional slots 105, which are equally spaced between the first three slots 105. These three additional slots 105 are aligned with holes in the piston sleeve 101, to allow mud to flow through the piston sleeve 101.

An O-ring seal 115 seals between the bottom housing 27 and the center housing 25. However, the mud passing through the piston sleeve 101 can exit through mud exit ports 117 in the bottom housing sleeve 83.

At one point along the length of the bottom housing 27, there is a bend or angle 119 in the longitudinal axis 121 of the bottom housing 27. This angle 119 is preferably only about $\frac{1}{8}$ degree, so the angle 119 is not noticeable in the drawings. This angle 119 is in the same plane as the angle 43 in the longitudinal axis 45 of the top housing 23. Therefore, the sum of the angles 43, 119 in the longitudinal axes 45, 121 of the top and bottom housings 23, 27 is $\frac{1}{4}$ degree.

Figure 6:
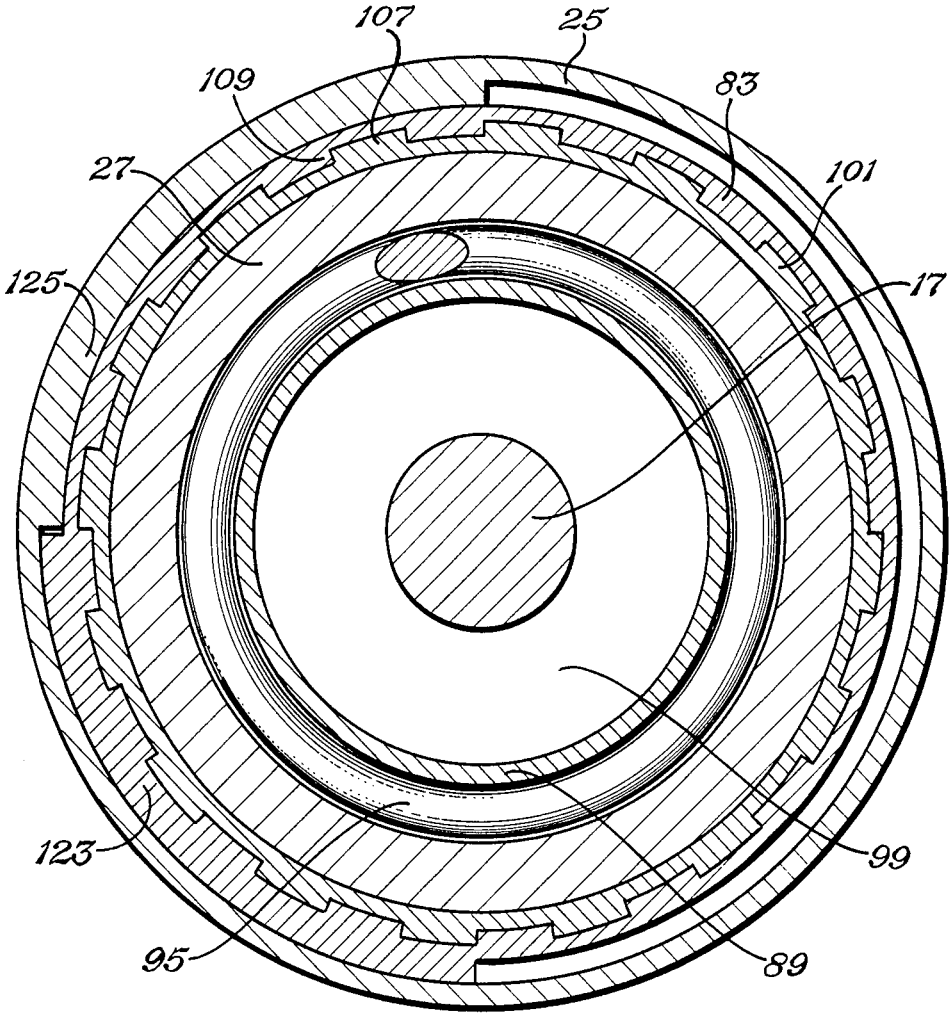
FIG. 6 is a sectional view as seen along line 6—6 in FIG. 3.

FIG. 6 shows that the bottom housing sleeve 83 has a dog 123, which extends ninety degrees around the circumference of the bottom housing sleeve 83. This dog 123 engages a dog 125 on the center housing 25. The dog 125 on the center housing 25 extends ninety degrees around the inner circumference of the center housing 25. These dogs 123, 125 are a means for limiting the rotation of the bottom housing sleeve 83 relative to the center housing 25 to no more than 180 degrees. The top and bottom housings 23, 27 rotate with the bottom housing sleeve 83, so rotation of those housings 23, 27 relative to the center housing 25 is similarly limited.

During the assembly of the connector housing 11, the coupling 51 is first threaded completely onto the bottom housing 27. The top and center housings 23, 25 are then placed in position. The center housing 25 is then rotated relative to the top and bottom housings 23, 27.

The splines 69 on the center housing 25 are engaged with the splines 67 on the coupling 51, and cause the coupling 51 to be rotated relative to the top and bottom housings 23, 27 as the center housing 25 is rotated. The center housing 25 is rotated until the coupling 51 moves up to engage threads 57, 61 on both the top and bottom housings 23, 27. The top and bottom housings 23, 27 are then held together longitudinally by the coupling 51.

In operation, when drilling fluid is being pumped through the bore 99 of the connector housing 11, the fluid pressure forces the piston 89 up to its upper, or locked, position. In this position, the top and bottom housings 23, 27 are locked against rotation relative to the center housing 25.

If it is desirable to drill a straight hole, the angles 71 in the longitudinal axis 73 of the center housing 25 will be aligned in the opposite direction from the angles 43, 119 in the longitudinal axes 45, 121 of the top and bottom housings 23, 27. The sum of the angles 43, 71, 119 is then zero degrees, and the connector housing 11 will be straight.

If it is desirable to drill a slanted hole, the top and bottom housings 23, 27 can be rotated 180 degrees relative to the center housing 25. This aligns the angles 43, 119 in the longitudinal axes 45, 121 of the top and bottom housings 23, 27 in the same direction as the angle 71 in the longitudinal axis 73 of the center housing 25.

The first step in changing the angle of the connector housing 11 is to shut off the flow of drilling fluid. This allows the spring 93 to force the piston 89 down to its lower, or unlocked, position. With the piston 89 in the lower, or unlocked, position, the splines 107 on the piston sleeve 101 no longer engage the splines 111 on the center housing 25. The top and bottom housings 23, 27 are then able to rotate relative to the center housing 25.

The drill string is rotated by the rotary table (not shown), to cause the top and bottom housings 23, 27 to rotate. The stabilizer 47 will contact the sides of the borehole, causing the center housing 25 not to rotate with the top and bottom housings 23, 27. The stabilizer 47 is thus a means for rotating the top and bottom housings 23, 27 relative to the center housing 25. The top and bottom housings 23, 27 will rotate relative to the center housing 25 until the dogs 123, 125 on the bottom housing sleeve 83 and on the center housing 25 limit further relative rotation.

At that point, the angles 71 in the longitudinal axis 73 of the center housing 25 will be aligned in the same direction as the angles 43, 119 in the longitudinal axes 45, 121 of the top and bottom housings 23, 27. The sum of the angles 43, 71, 119 will be ½ degree, sufficient to cause the bit to drill an angled borehole.

The connector housing 11 of the invention has several advantages over the prior art. No bent sub is required, so movement of the drill string into and out of the borehole is easier without the side load causing resistance to movement. The connector housing 11 of the invention is relatively simple to manufacture and to use, and provides a relatively easy method of adjusting the angle of drilling, without having to remove the drill string from the hole.

The invention has been shown in only one of its forms. It should be apparent to those skilled in the art that it is not so limited, but is susceptible to various changes and modifications without departing from the spirit thereof. For example, the longitudinal axes of the various housings may have offsets, rather than angles as shown in the preferred embodiment. Also, there are other means for rotating the top and bottom housings relative to the center housing.

I claim:

1. A connector housing for use in directional drilling, the connector housing comprising:

a top housing, having an angle in the longitudinal axis of the top housing;

a bottom housing, having an angle in the longitudinal axis of the bottom housing, aligned in the same direction as the angle in the longitudinal axis of the top housing;

means for preventing rotation of the top housing and the bottom housing relative to one another;

a center housing, having an angle in the longitudinal axis of the center housing, the angle in the longitudinal axis of the center housing being aligned in a direction other than the opposite direction from the angles in the longitudinal axes of the top and bottom housings for drilling a slanted hole; and means for rotating the top and bottom housings relative to the center housing to align the angles in the longitudinal axes of the top and bottom housings in the opposite direction from the angle in the longitudinal axis of the center housing for drilling a straight hole.

2. A connector housing for use in directional drilling, the connector housing comprising:

a top housing, having an angle in the longitudinal axis of the top housing;

a bottom housing, having an angle in the longitudinal axis of the bottom housing, aligned in the same direction as the angle in the longitudinal axis of the top housing;

means for preventing rotation of the top housing and the bottom housing relative to one another;

a center housing, having an angle in the longitudinal axis of the center housing, the angle in the longitudinal axis of the center housing being aligned in the same direction as the angles in the longitudinal axes of the top and bottom housings for drilling a slanted hole; and means for rotating the top and bottom housings up to 180 degrees relative to the center housing to align the angles in the longitudinal axes of the top and bottom housings in the opposite direction from the angle in the longitudinal axis of the center housing for drilling a straight hole.

3. A connector housing for use in directional drilling, the connector housing comprising:

a top housing, having an angle in the longitudinal axis of the top housing;

a bottom housing, having an angle in the longitudinal axis of the bottom housing, aligned in the same direction as the angle in the longitudinal axis of the top housing;

means for preventing rotation of the top housing and the bottom housing relative to one another;

a center housing, having an angle in the longitudinal axis of the center housing equal to the sum of the angles in the longitudinal axes of the top and bottom housings, the angle in the longitudinal axis of the center housing being aligned in the same direction as the angles in the longitudianl axes of the top and bottom housings for drilling a slanted hole; and means for rotating the top and bottom housings relative to the center housing to align the angles in the longitudinal axes of the top and bottom housings in the opposite direction from the angle in the longitudinal axis of the center housing for drilling a straight hole.

4. A connector housing for use in directional drilling, the connector housing comprising:

a top housing, having an angle in the longitudinal axis of the top housing;

a bottom housing, having an angle in the longitudinal axis of the bottom housing, aligned in the same direction as the angle in the longitudinal axis of the top housing;

means for preventing rotation of the top housing and the bottom housing relative to one another;

a center housing, having an angle in the longitudinal axis of the center housing, the angle in the longitudinal axis of the center housing being aligned in the same direction as the angles in the longitudinal axes of the top and bottom housings for drilling a slanted hole;

means for holding the top and bottom housings against rotation relative to the center housing while drilling fluid is being pumped through the connector housing, and for allowing rotation of the top and bottom housings relative to the center housings while drilling fluid is not being pumped through the connector housing; and means for rotating the top and bottom housings relative to the center housing to align the angles in the longitudinal axes of the top and bottom housings in the opposite direction from the angle in the longitudinal axis of the center housing for drilling a straight hole.

5. A connector housing for use in directional drilling, the connector housing comprising:

a top housing, having an angle in the longitudinal axis of the top housing;

a bottom housing, having an angle in the longitudinal axis of the bottom housing, aligned in the same direction as the angle in the longitudinal axis of the top housing;

means for preventing rotation of the top housing and the bottom housing relative to one another;

a center housing, having an angle in the longitudinal axis of the center housing, the angle in the longitudinal axis of the center housing being aligned in the same direction as the angles in the longitudinal axes of the top and bottom housings for drilling a slanted hole;

a stabilizer on the center housing, to hold the center housing against rotation as the top and bottom housings are rotated, to align the angles in the longitudinal axes of the top and bottom housings in the opposite direction from the angle in the longitudinal axis of the center housing for drilling a straight hole;

a piston, mounted for reciprocal movement between a locked position and an unlocked position, wherein the piston in the locked position holds the top and bottom housings against rotation relative to the center housing, and wherein the piston in the unlocked position allows rotation of the top and bottom housings relative to the center housing; and bias means for biasing the piston in the unlocked position, wherein the bias means is overcome and the piston is moved to the locked position by drilling fluid when the drilling fluid is pumped through the connector housing.

6. A connector housing for use in directional drilling, the connector housing comprising:

a top housing, having an angle in the longitudinal axis of the top housing;

a bottom housing, having an angle in the longitudinal axis of the bottom housing, aligned in the same direction as the angle in the longitudinal axis of the top housing;

means for preventing rotation of the top housing and the bottom housing relative to one another.

a center housing, having an angle in the longitudinal axis of the center housing, the angle in the longitudinal axis of the center housing being aligned in the same direction as the angles in the longitudinal axes of the top and bottom housings for drilling a slanted hole;

means for rotating the top and bottom housings relative to the center housing to align the angles in the longitudinal axes of the top and bottom housings in the opposite direction from the angle in the longitudinal axis of the center housing for drilling a straight hole; and means for limiting the rotation of the top and bottom housings relative to the center housing to no more than 180 degrees.

7. A connector housing for use in directional drilling, the connector housing comprising:

a top housing, having an angle in the longitudinal axis of the top housing;

a bottom housing, having an angle in the longitudinal axis of the bottom housing, aligned in the same direction as the angle in the longitudinal axis of the top housing;

means for preventing rotation of the top housing and the bottom housing relative to one another;

a center housing, having an angle in the longitudinal axis of the center housing, the angle in the longitudinal axis of the center housing being aligned in the same direction as the angles in the longitudinal axes of the top and bottom housings for drilling a slanted hole;

a stabilizer on the center housing, wherein the stabilizer tends to hold the center housing against rotation as the top and bottom housings are rotated, to align the angles in the longitudinal axes of the top and bottom housings in the opposite direction from the angle in the longitudinal axis of the center housing for drilling a straight hole;

a piston, mounted for reciprocal movement between a locked position and an unlocked position, wherein the piston in the locked position holds the top and bottom housings against rotation relative to the center housing, and wherein the piston in the unlocked position allows rotation of the top and bottom housings relative to the center housing;

bias means for biasing the piston in the unlocked position, wherein the bias means is overcome and the piston is moved to the locked position by drilling fluid when the drilling fluid is pumped through the connector housing; and means for limiting the rotation of the top and bottom housings relative to the center housing to no more than 180 degrees.

8. A connector housing for use in directional drilling, the connector housing comprising:

a top housing, having an angle in the longitudinal axis of the top housing;

a bottom housing, having an angle in the longitudinal axis of the bottom housing, aligned in the same direction as the angle in the longitudinal axis of the top housing;

means for preventing rotation of the top housing and the bottom housing relative to one another;

a center housing, having a pair of angles in the longitudinal axis of the center housing, wherein the sum of the angles in the longitudinal axis of the center housing is equal to the sum of the angles in the longitudinal axes of the top and bottom housings, the angles in the longitudinal axis of the center housing being aligned in the same direction as the angles in the longitudinal axes of the top and bottom housings for drilling a slanted hole;

a stabilizer on the center housing, to hold the center housing against rotation as the top and bottom housings are rotated, to align the angles in the longitudinal axes of the top and bottom housings in the opposite direction from the angle in the longitudinal axis of the center housing for drilling a straight hole;

a piston, mounted for reciprocal movement between a locked position and an unlocked position, wherein the piston in the locked position holds the top and bottom housings against rotation relative to the center housing, and wherein the piston in the unlocked position allows rotation of the top and bottom housings relative to the center housing; and bias means for biasing the piston in the unlocked position, wherein the bias means is overcome and the piston is moved to the locked position by drilling fluid when the drilling fluid is pumped through the connector housing.

* * * * *